US010723037B2

(12) United States Patent
Hung et al.

(10) Patent No.: US 10,723,037 B2
(45) Date of Patent: Jul. 28, 2020

(54) NAIL GUN AND A DRIVING DEVICE THEREOF

(71) Applicant: Basso Industry Corp., Taichung (TW)

(72) Inventors: Liang-Chi Hung, Taichung (TW); Li-Hsin Chang, Taichung (TW); Sheng-Man Wang, Taichung (TW)

(73) Assignee: Basso Industry Corp., Taichung (TW)

( * ) Notice: Subject to any disclaimer, the term of this patent is extended or adjusted under 35 U.S.C. 154(b) by 192 days.

(21) Appl. No.: 16/109,010

(22) Filed: Aug. 22, 2018

(65) Prior Publication Data

US 2019/0061196 A1 Feb. 28, 2019

(30) Foreign Application Priority Data

Aug. 25, 2017 (TW) ..... 106128886 A

(51) Int. Cl.

| | |
|---|---|
| ***B25C 1/04*** | (2006.01) |
| ***B27F 7/09*** | (2006.01) |
| ***B25C 1/00*** | (2006.01) |
| ***B25C 1/18*** | (2006.01) |

(52) U.S. Cl.

CPC ..... *B27F 7/09* (2013.01); *B25C 1/008* (2013.01); *B25C 1/04* (2013.01); *B25C 1/043* (2013.01); *B25C 1/188* (2013.01); *B25C 1/001* (2013.01)

(58) Field of Classification Search

CPC .. B25C 1/00; B25C 1/008; B25C 1/04; B25C 1/043; B25C 1/188; B25C 1/18

USPC ..... 227/8, 10, 120, 130, 136, 138, 156

See application file for complete search history.

(56) References Cited

U.S. PATENT DOCUMENTS 5,191,861 A * 3/1993 Kellerman ..... B25C 1/08 123/46 SC
5,366,132 A * 11/1994 Simonelli ..... B25C 1/008 227/130
6,199,739 B1 * 3/2001 Mukoyama ..... B25C 1/008 227/120
6,966,477 B1 * 11/2005 Chien-Kuo ..... B25C 1/005 227/120

(Continued)

FOREIGN PATENT DOCUMENTS

DE 202013103822 U1 11/2013

OTHER PUBLICATIONS

European Patent Office "Extended European Search Report," issued in European patent application No. 18190688.4, dated Feb. 18, 2019, document of 8 pages.

*Primary Examiner* — Scott A Smith

(74) *Attorney, Agent, or Firm* — Akerman LLP; Peter A. Chiabotti

(57) ABSTRACT

A nail gun includes a muzzle device, a cartridge device and a driving device. The muzzle device includes a safety member having an abutment end retractable when pushed. The cartridge device includes a stop member for blocking the drive stroke when a number of the nails is less than a predetermined number. The driving device includes a linking member co-movable with the safety member, and a trigger unit including a pivotable trigger, an inner arm co-movable with the trigger, and a switch member. When the switch member is at a sequential striking position and when the trigger is pivoted before a rearward movement of the linking member, the inner arm is withdrawn from a route of the rearward movement to avoid actuation of the drive stroke.

16 Claims, 10 Drawing Sheets

(56) References Cited

U.S. PATENT DOCUMENTS

| | | | | |
|---|---|---|---|---|
| 7,086,573 | B1 * | 8/2006 | Wen | B25C 1/005 227/120 |
| 7,140,524 | B2 * | 11/2006 | Hung | B25C 1/008 227/8 |
| 7,143,918 | B2 * | 12/2006 | Aguirre | B25C 1/008 227/8 |
| 7,559,447 | B2 * | 7/2009 | Chen | B25C 1/008 227/130 |
| 7,753,244 | B2 * | 7/2010 | Nagata | B25C 1/184 227/120 |
| 8,011,548 | B2 * | 9/2011 | Chang | B25C 1/047 227/125 |
| 8,833,626 | B2 | 9/2014 | Perron et al. | |
| 2007/0125821 | A1 * | 6/2007 | Wang | B25C 1/047 227/8 |
| 2008/0135596 | A1 * | 6/2008 | Wu | B25C 1/008 227/8 |
| 2009/0314818 | A1 | 12/2009 | Segura | |
| 2010/0012700 | A1 | 1/2010 | Perron et al. | |
| 2010/0206933 | A1 * | 8/2010 | Wu | B25C 1/08 227/8 |
| 2011/0062207 | A1 | 3/2011 | Hlinka et al. | |

* cited by examiner

NAIL GUN AND A DRIVING DEVICE THEREOF

CROSS-REFERENCE TO RELATED APPLICATION

This application claims priority of Taiwanese Invention Patent Application No. 106128886, filed on Aug. 25, 2017.

FIELD

The disclosure relates to a driving device, and more particularly to a nail gun and a driving device thereof.

BACKGROUND

U.S. Pat. No. 8,833,626B2 discloses an actuation device of a fastening tool. Referring to FIGS. 3 to 5 of the U.S. patent, the actuation device mainly includes a contact trip assembly 130 of a movable nose 150 connected to a nose assembly 22, a trigger assembly 110 including a trigger 112, and a check pawl 116. The contact trip assembly 130 includes a lower contact arm 132 connected to the movable nose 150, and an upper contact arm 134 connected to the contact arm 132 and being formed with an opening 140.

By changing the operation sequence of the contact trip assembly 130 and the trigger 112, the fastening tool can be operated in a sequential striking mode (see FIGS. 5 to 10 of the U.S. patent), where, after a single strike, the check pawl 116 engages the opening 140 of the opening 140 upper contact arm 134 to avoid further strike, or a repetitive striking mode (see FIGS. 11 to 14 of the U.S. patent), where multiple strikes are allowed.

During manufacturing of the abovementioned actuation device, the contact trip assembly 130 needs to be processed to form the opening 140, and the check pawl 116 needs to be formed with a protrusion for engagement with the opening 140, thereby increasing the complexity of the structure and manufacturing difficulty. Moreover, the check pawl 116 and the opening 140 may not be properly aligned during operation.

SUMMARY

Therefore, an object of the disclosure is to provide a nail gun and a driving device thereof that can alleviate at least one of the drawbacks of the prior art.

According to a first aspect of the present disclosure, a nail gun includes a housing, a power device, a muzzle device, a cartridge device and a driving device.

The power device is disposed in the housing for providing power during a drive stroke. The muzzle device is coupled to the housing, and includes a plate member and a safety member. The safety member cooperates with the plate member to define a nail ejection opening, has an abutment end extending beyond the nail ejection opening, and is retractable when the abutment end is pushed by an object to be fastened. The cartridge device is coupled to the muzzle device, is adapted for supplying nails into the muzzle device for performance of the drive stroke, and includes a stop member that is operable for blocking the drive stroke when a number of the remainder of the nails is less than a predetermined number. The driving device includes a linking unit and a trigger unit. The linking unit includes a linking member that is connected co-movably to the safety member. The trigger unit includes a trigger, an inner arm and a switch member. The trigger is connected pivotally to the housing.

The inner arm is connected co-movably to the trigger, such that a pivot movement of the trigger and a rearward movement of the linking member which is driven by the retraction of the abutment end of the safety member cooperatively move the inner arm to actuate the drive stroke. The switch member is movable between a sequential striking position and a repetitive striking position. When the switch member is at the sequential striking position and when the pivot movement of the trigger is performed before the rearward movement of the linking member, the inner arm is withdrawn from a route of the rearward movement of the linking member, thereby avoiding actuation of the drive stroke.

According to a second aspect of the present disclosure, a driving device is adapted for use in a nail gun.

The nail gun includes a muzzle device and a safety member. The muzzle device includes a plate member. The safety member cooperates with the plate member to define a nail ejection opening, has an abutment end extending beyond the nail ejection opening, and is retractable when the abutment end is pushed by an object to be fastened.

The driving device includes a linking member, a trigger, an inner arm and a switch member. The linking member is adapted to be connected co-movably to the safety member. The trigger is pivotable. The inner arm is connected co-movably to the trigger, such that a pivot movement of the trigger and a rearward movement of the linking member which is driven by the retraction of the abutment end of the safety member cooperatively move the inner arm to actuate a drive stroke. The switch member is movable between a sequential striking position and a repetitive striking position. When the switch member is at the sequential striking position and when the pivot movement of the trigger is performed before the rearward movement of the linking member, the inner arm is withdrawn from a route of the rearward movement of the linking member, thereby avoiding actuation of the drive stroke.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
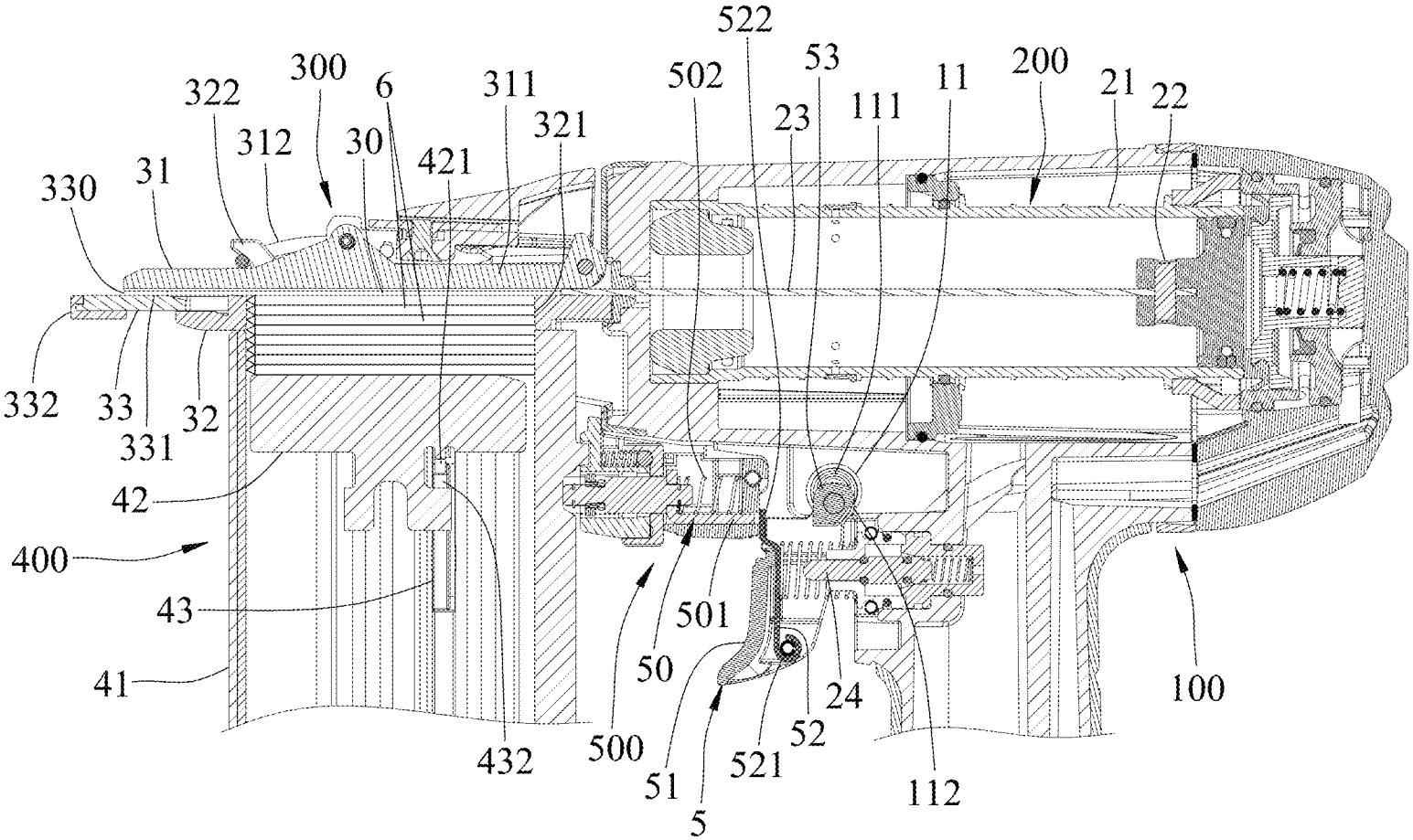
FIG. 1 is a fragmentary sectional view of an embodiment of a nail gun according to the present disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
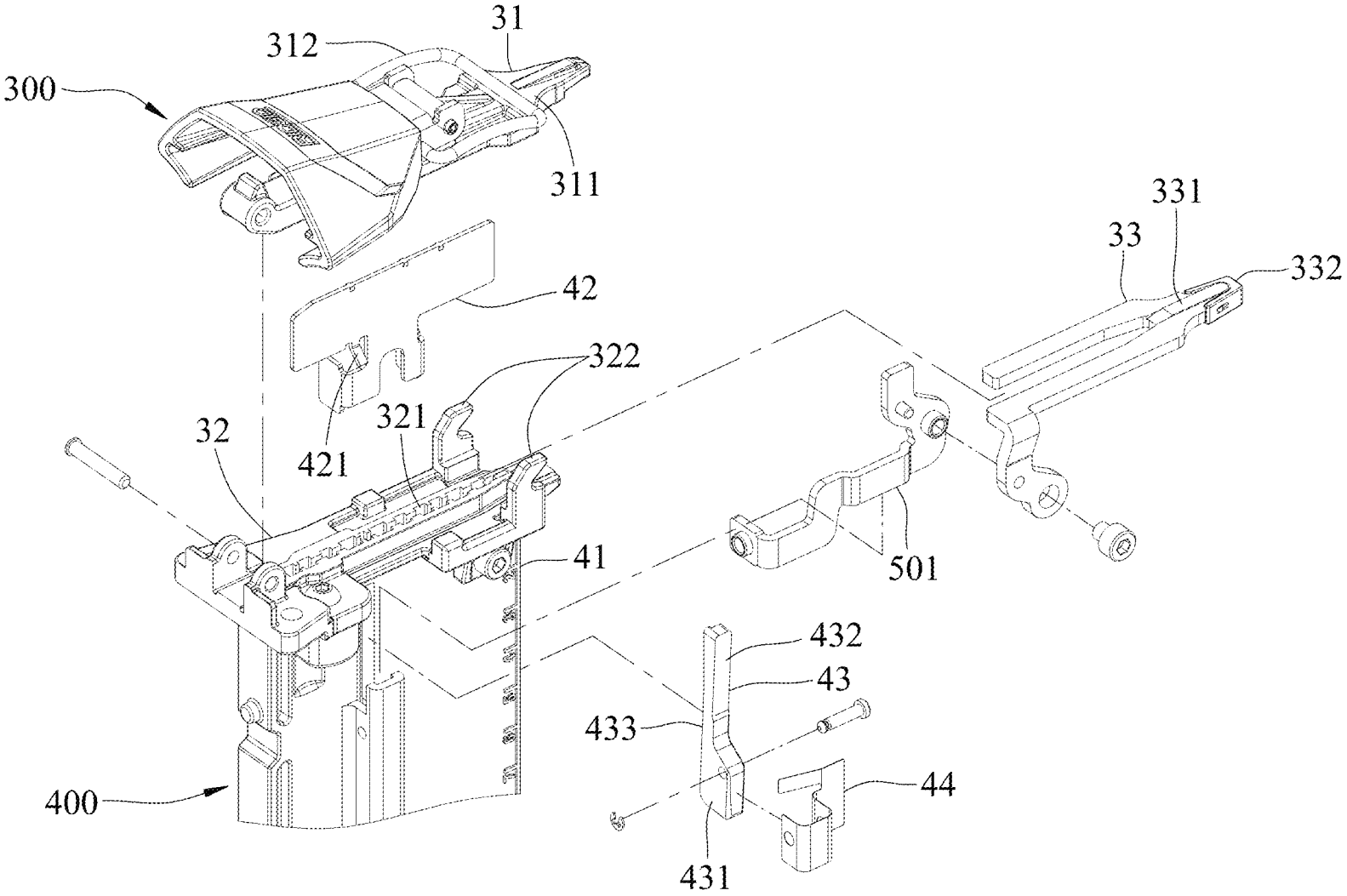
FIG. 2 is a fragmentary and partly exploded perspective view of the embodiment.
Figure 3:
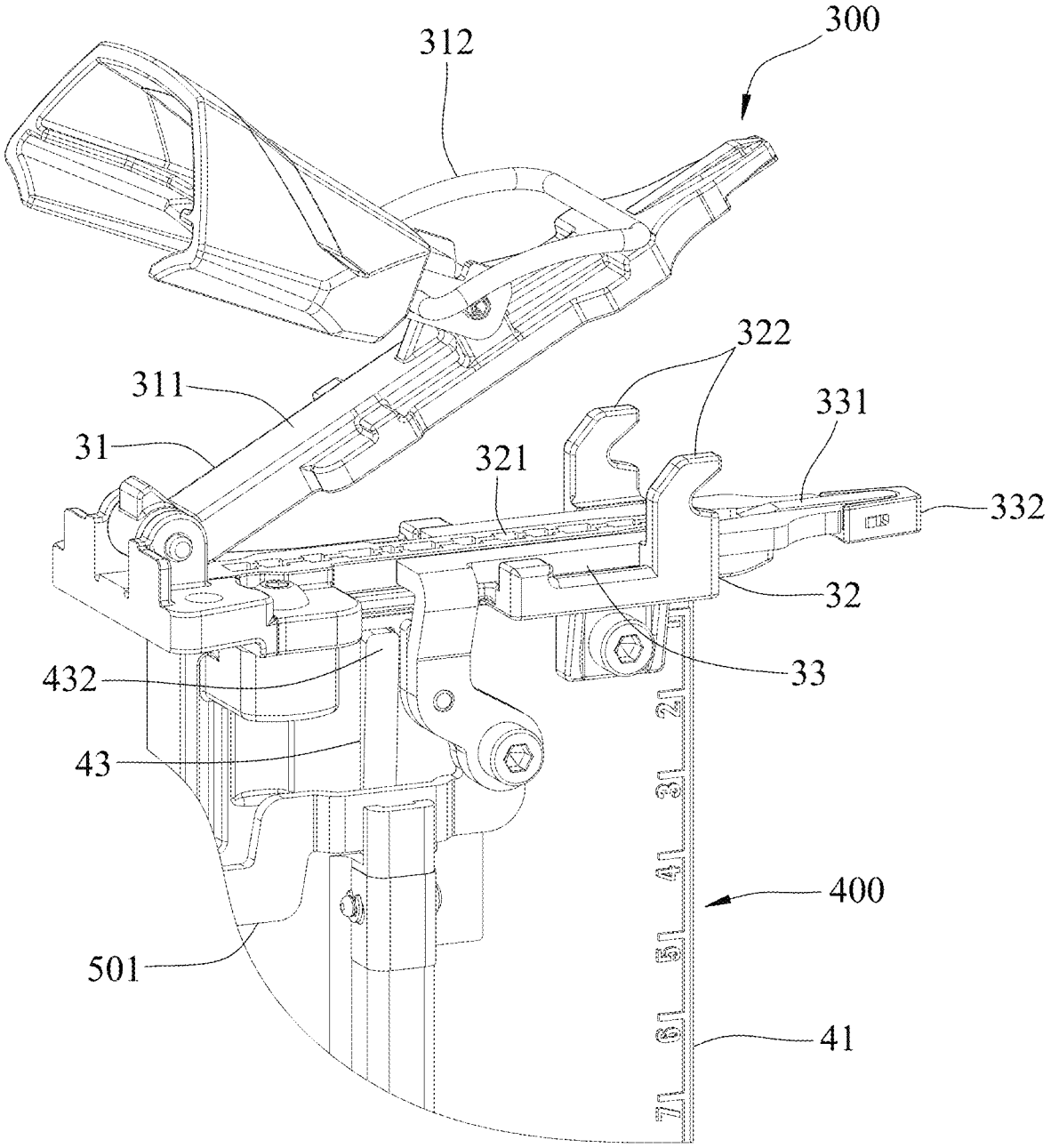
FIG. 3 is a fragmentary perspective view of the embodiment, showing a locking piece of a plate member of a muzzle device of the embodiment being disengaged from two hook portions of a barrel member of the muzzle device.

Referring to FIGS. 1, 2 and 3, an embodiment of the nail gun according to the present disclosure includes a housing 100, a power device 200, a muzzle device 300, a cartridge device 400 and a driving device 500.

The housing 100 is formed with a positioning hole 11 that has a first positioning portion 111 and a second positioning portion 112.

The power device 200 is disposed in the housing 100 for providing power during a drive stroke. In this embodiment, the power device 200 is pneumatic, and includes a cylinder body 21 for receiving compressed gas, a piston 22 disposed in the cylinder body 21 and drivable by the compressed gas, a nail striking pin 23 co-movably connected to the piston 22 for striking nails 6, and a valve stem 24 connected to the housing 100 and operable to allow the compressed gas to enter the cylinder body 21. Alternatively, the power device 200 may use other power source, such as natural gas, and may be changed according to practical requirements.

The muzzle device 300 is coupled to a front end of the housing 100, and includes a plate member 31, a barrel member 32 that cooperates with the plate member 31 to define a nail passage 30 adapted for passage of the nails 6 advanced from the cartridge device 400, and a safety member 33 that is disposed between the plate member 31 and the barrel member 32. The plate member 31 includes a plate body 311, and a lock piece 312 that is connected pivotally to the plate body 311 and that engages removably the barrel member 32 for maintaining relative position between the plate member 31 and the barrel member 32. Specifically, the barrel member 32 has a nail receiving opening 321 for entrance of the nails 6 into the nail passage 30, and two hook portions 322 that cooperatively and removably hook the lock piece 312 of the plate member 31. The safety member 33 has a flat surface 331 that cooperates with the plate member 31 to define a nail ejection opening 330, and an abutment end 332 that extends beyond the nail ejection opening 330. The safety member 33 is retractable when the abutment end 332 is pushed by an object to be fastened (not shown). In this embodiment, the nail ejection opening 330 overlaps the nail passage 30.

Figure 9:
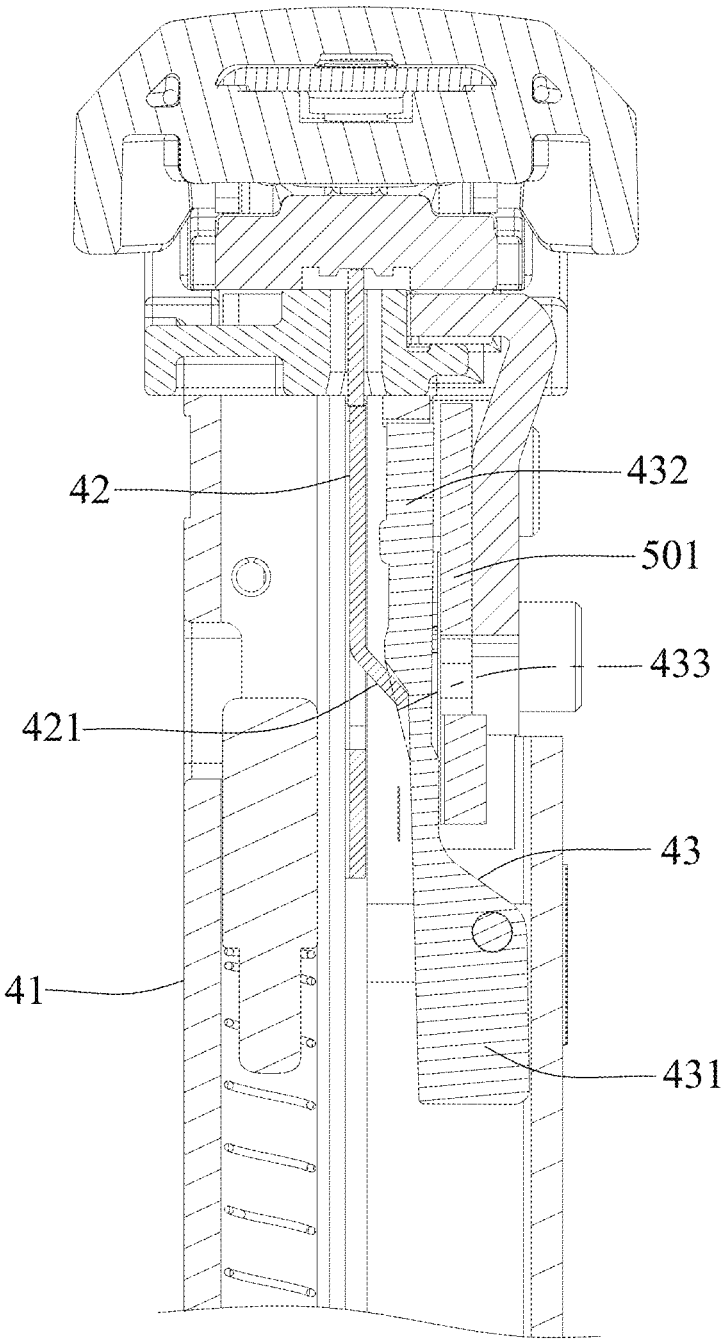
FIG. 9 is a fragmentary sectional view of the embodiment, showing a push plate and a stop member of a cartridge device of the embodiment.
Figure 10:
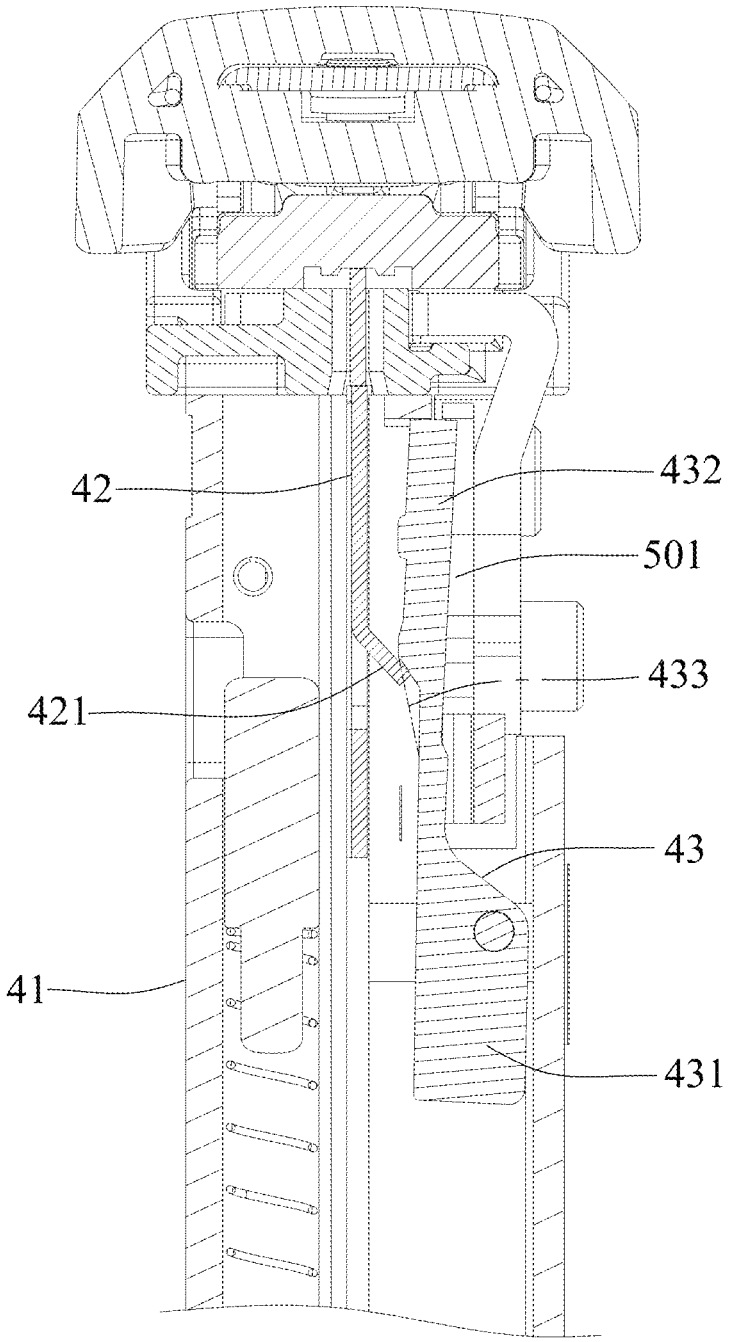
FIG. 10 is a fragmentary sectional view of the embodiment, showing the push plate pushing the stop member to block the linking member.

The cartridge device 400 is coupled to the muzzle device 300 and is adapted for supplying the nails 6 into the muzzle device 300 for performance of the drive stroke. Specifically, the cartridge device 400 includes a nail cartridge 41 that is adapted for receiving the nails 6, a push plate 42 that is disposed in the nail cartridge 41 and that is slidable for advancing the nails 6 into the muzzle device 300, a stop member 43 that is connected pivotally to the nail cartridge 41, that is adjacent to the muzzle device 300 and that is operable for blocking the drive stroke when a number of the remainder of the nails 6 in the nail cartridge 41 is less than a predetermined number, and a spring clip 44 that is connected between the nail cartridge 41 and the stop member 43. The push plate 42 has a protrusion 421, and is operable for advancing the nails 6 one-by-one from the nail cartridge 41 into the nail passage 30 through the nail receiving opening 321 of the barrel member 32. Referring further to FIGS. 9 and 10, the stop member 43 has a connecting portion 431 that is connected pivotally to the nail cartridge 41, a blocking portion 432 that extends partially into the nail cartridge 41, and a contact surface 433 that faces the push plate 42. The spring clip 44 continuously biases the blocking portion 432 of the stop member 43 into the nail cartridge 41.

The driving device 500 is operable to actuate the drive stroke to eject the nails 6 in the nail passage 30 one at a time through the nail ejection opening 330, and includes a linking unit 50 and a trigger unit 5.

The linking unit 50 includes a linking member 501 that is connected co-movably to the safety member 33, and a resilient member 502 that is disposed between the linking member 501 and the housing 100 for continuously biasing the abutment end 332 of the safety member 33 away from the nail ejection opening 330. The linking member 501 passes a swing path of the blocking portion 432 of the stop member 43.

The trigger unit 5 includes a trigger 51, an inner arm 52 and a switch member 53. The trigger 51 is connected pivotally to the housing 100. The inner arm 52 is connected co-movably to the trigger 51, and has a connecting end portion 521 that is connected pivotally to the trigger 51, and a free end portion 522 that is opposite to the connecting end portion 521. The switch member 53 engages the positioning hole 11, and is movable between a sequential striking position (see FIGS. 5 and 6), where the switch member 53 is positioned at the second portion 112 of the positioning hole 11, and a repetitive striking position (see FIGS. 7 and 8), where the switch member 53 is positioned at the first positioning portion 111 of the positioning hole 11. The movement of the switch member 53 between the sequential striking position and the repetitive striking position drives movement of the trigger 51 and the inner arm 52 relative to the linking member 501.

Figure 7:
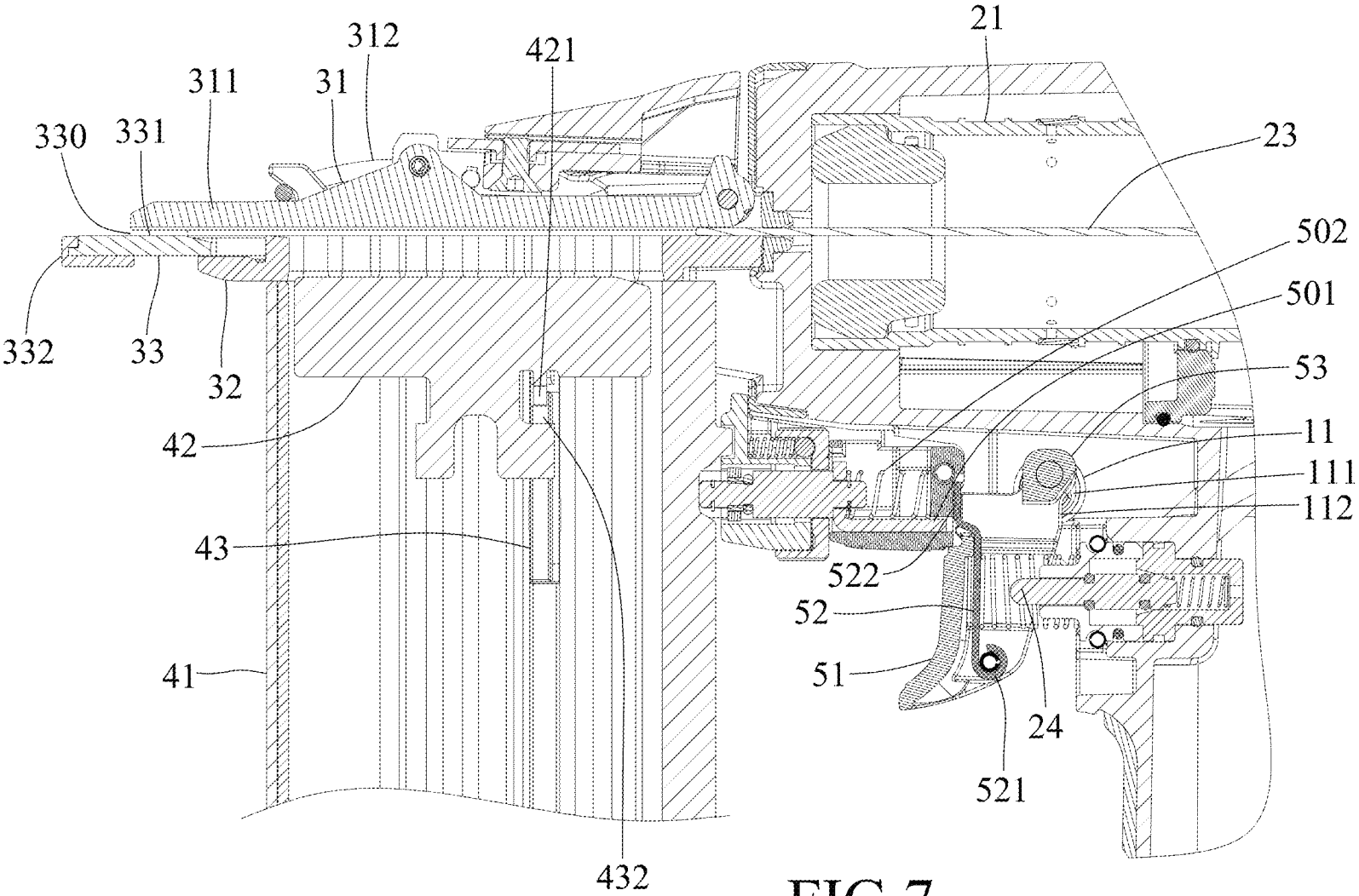
FIG. 7 is a fragmentary sectional view of the embodiment, showing the switch member being at a repetitive striking position.

Referring to FIGS. 1 and 7, when the nail gun is not in use, the trigger 51 is pivoted away from the housing 100, the safety member 33 and the linking member 501 are biased by the resilient member 502 in a direction toward the front end of the housing 100 such that the abutment end 332 extends beyond the nail ejection opening 330.

Figure 4:
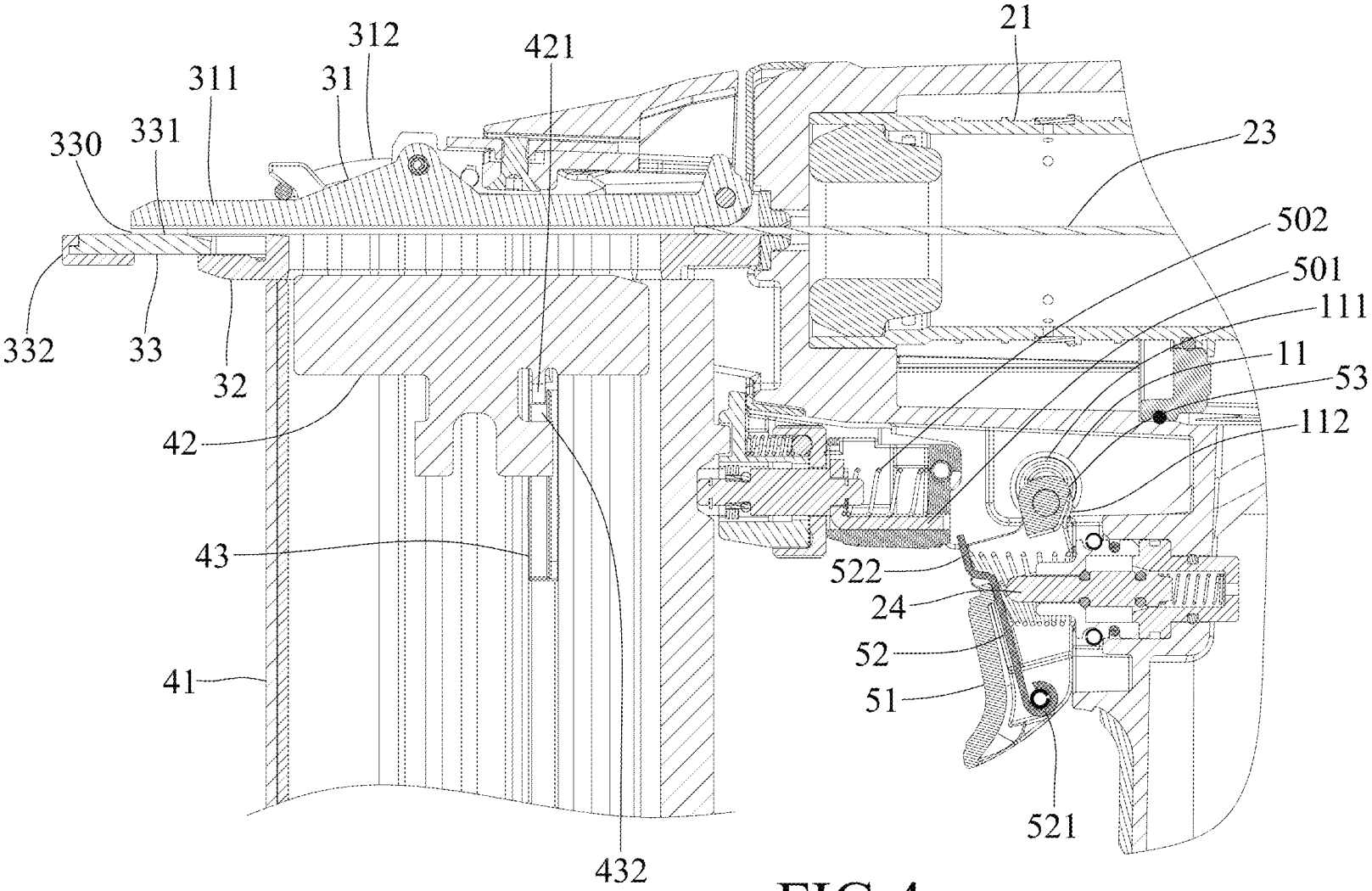
FIG. 4 is a fragmentary sectional view of the embodiment, showing a switch member of a trigger unit of a driving device of the embodiment being at a sequential striking position and a trigger of the trigger unit of the driving device being pivoted.
Figure 5:
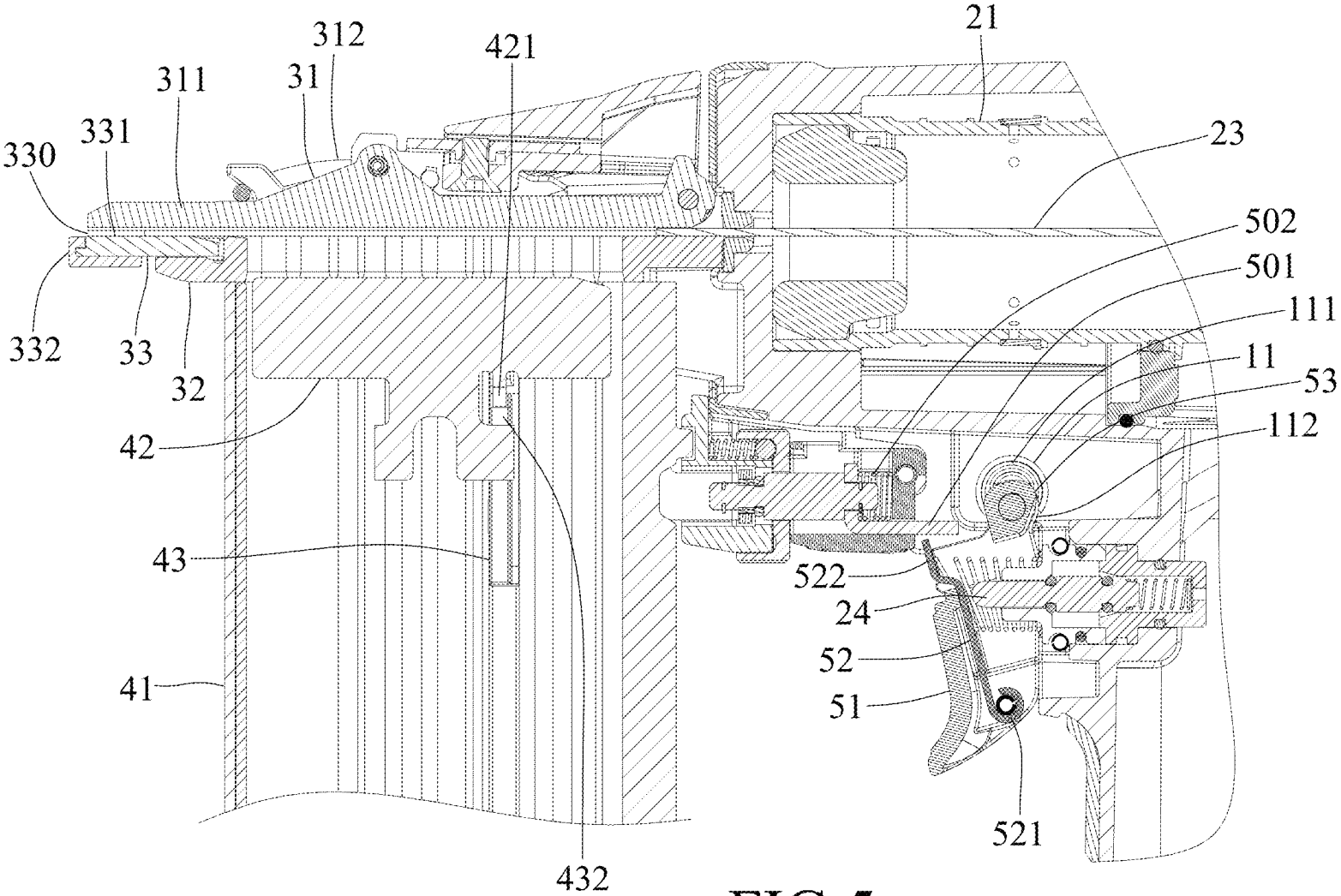
FIG. 5 is a view similar to FIG. 4, but showing a linking member of a linking unit of the driving device being moved backwardly without interfering with an inner arm of the trigger unit.
Figure 6:
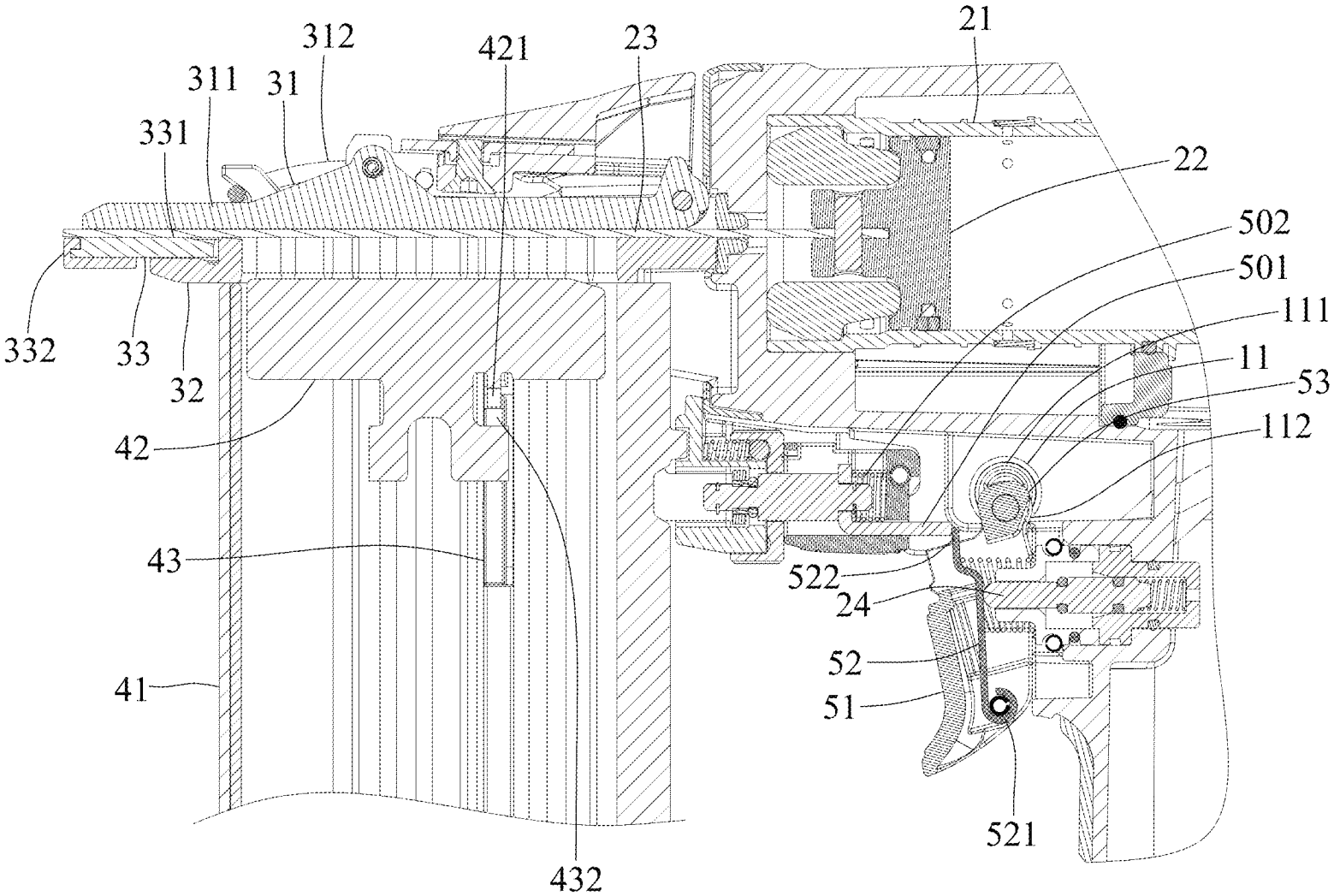
FIG. 6 is a fragmentary sectional view of the embodiment, showing that the switch member is at the sequential striking position, and that the linking member is moved backwardly to push the inner arm prior to the pivot movement of the trigger, so that the pivot movement of the trigger actuates a valve stem of a power device.

Referring to FIGS. 4 to 6, a sequential striking operation of the nail gun will be described. As shown in FIG. 4, when the switch member 53 is at the sequential striking position, and when the trigger 51 is pivoted toward the housing 100 with the abutment end 332 of the safety member 33 not being pressed against the object to be fastened (i.e., the pivot movement of the trigger 51 is performed before a rearward movement of the linking member 501), the connecting end portion 521 of the inner arm 52 co-moves with the trigger 51 toward the housing 100 and the free end portion 522 of the inner arm 52 abuts against the valve stem 24 and is pushed away from the housing 100, such that the free end portion 522 of the inner arm 52 is withdrawn from a route of a rearward movement of the linking member 501. Referring to FIG. 5, afterwards, when the abutment end 332 of the safety member 33 is pressed against the object to be fastened, the abutment end 332 of the safety member 33 is retracted to drive the linking member 501 to move rearwardly and press the resilient member 502. Since the free end portion 522 of the inner arm 52 is withdrawn from the route of the rearward movement of the linking member 501, the inner arm 52 is not pushed by the linking member 501. In this case, the valve stem 24 is not actuated, and the drive stroke is not preformed.

Referring to FIG. 6, when the switch member 53 is at the sequential striking position and when the abutment end 332 of the safety member 33 is pressed against the object to be fastened with the trigger 51 not being pivoted (i.e., the rearward movement of the linking member 501 is performed before the pivot movement of the trigger 51), the linking member 501 is moved rearwardly to push the free end portion 522 of the inner arm 52 since the inner arm 52 is disposed on the route of the rearward movement of the linking member 501, such that the inner arm 52 is pivoted toward the housing 100 and presses against the valve stem 24. Afterwards, when the trigger 51 is pivoted, the inner arm 52 is moved further toward the housing 100 to actuate the valve stem 24, thereby performing the drive stroke.

When the drive stroke is performed, the valve stem 24 allows the compressed gas to enter the cylinder body 21, thereby pushing the piston 22 and the nail striking pin 23 to move forward. The nail striking pin 23 then strike one of the nails 6 in the nail passage 30 to shoot out the one of the nails 6 for fastening the object.

After the drive stroke, the nail gun is abruptly pushed away from the object by the counterforce of the drive stroke, in which a nail gun user may immediately press the abutment end 332 of the safety member 33 against the object once again. During the abrupt movement of the nail gun, the free end portion 522 of the inner arm 52 is not pressed by the linking member 501 and the inner arm 52 is pushed by the valve stem 24 such that the free end portion 522 of the inner arm 52 is not on the route of the rearward movement of the linking member 501 (see FIG. 5). In this situation, it is necessary to move the nail gun away from the object to return to the state of FIG. 4 before performing another striking operation.

Figure 8:
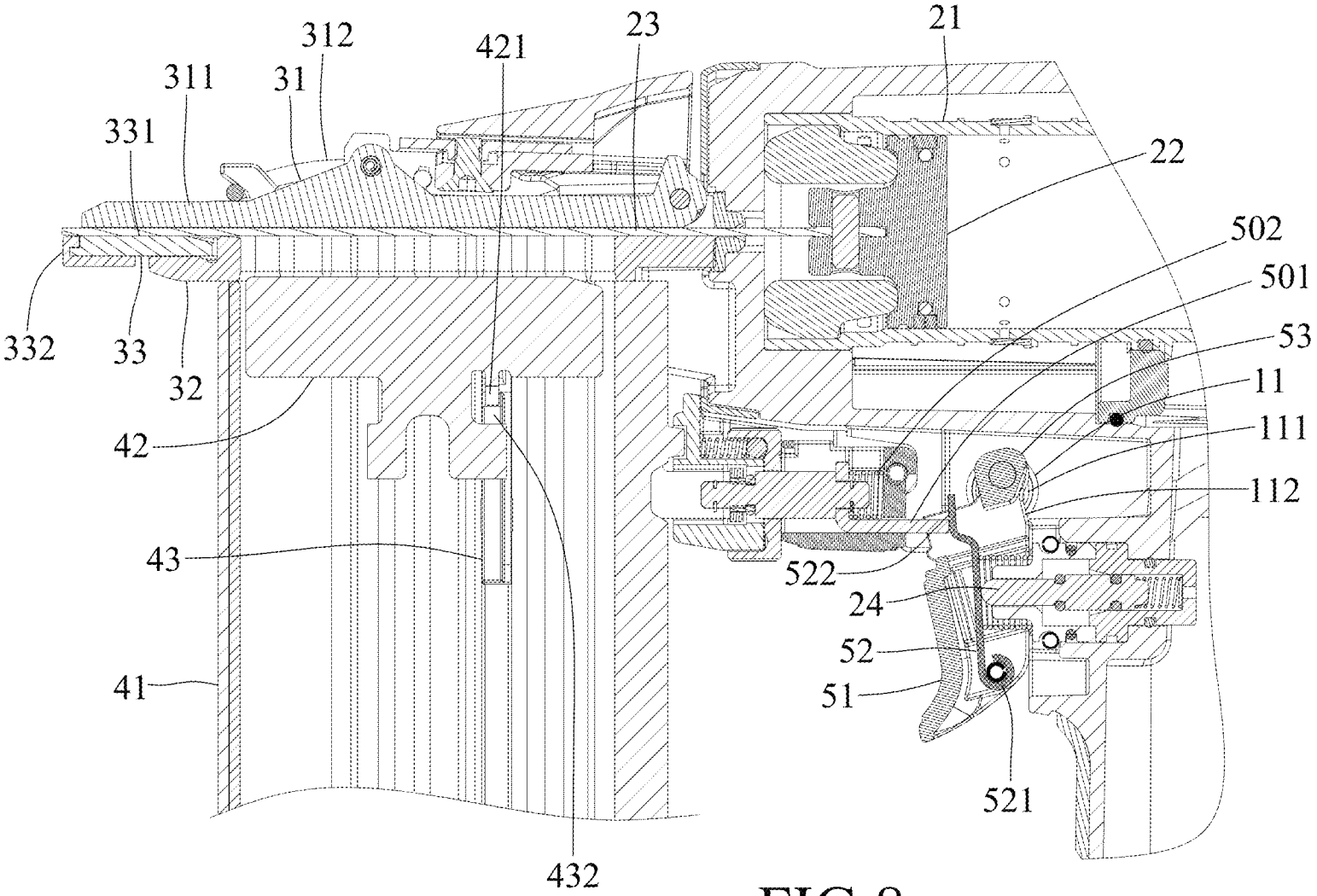
FIG. 8 is a view similar to FIG. 7, but showing the trigger being pivoted and the linking member being moved backwardly to actuate the valve stem.

Referring to FIGS. 7 and 8, a repetitive striking operation of the nail gun will be described. As shown in FIG. 7, when the switch member 53 is moved to the repetitive striking position, the trigger unit 5 is moved upwardly relative to the housing 100 and the linking member 501, such that the free end portion 522 of the inner arm 52 is moved on the route of the rearward movement of the linking member 501. Then, the trigger 51 is pivoted toward the housing 100, and the free end portion 522 of the inner arm 52 remains in the route of the rearward movement of the linking member 501. When the trigger 51 is kept being pressed, each abutment of the abutment end 332 of the safety member 33 against the object will cause the inner arm 52 to actuate the valve stem 24, thereby performing the drive stroke, and thereby allowing repetitive striking operation.

It is worth mentioning that, when the switch member 53 is at the repetitive striking position, the free end portion 522 of the inner arm 52 is always in the route of the rearward movement of the linking member 501, regardless of the abrupt movement of the nail gun. Therefore, by switching the switch member 53 to the repetitive striking position, followed by pressing the trigger 51 and the abutment end 332 of the safety member 33, the repetitive striking operation is performed.

Referring to FIGS. 6 and 8 to 10, the protrusion 421 of the push plate 42 is in slidable contact with the contact surface 433 of the stop member 43 when the number of the remainder of the nails 6 is less than the predetermined number (in this embodiment, when the last nail 6 is advanced from the nail cartridge 41 into the nail passage 30) to push the stop member 43 to the route of the rearward movement of the linking member 501, thereby blocking the drive stroke. It should be noted that the position of the stop member 43 relative to the barrel member 32 of the muzzle device 300 may be adjusted according to practical requirements for determining when to block the drive stroke based on the number of the remaining nails 6 in the nail cartridge 41. In this embodiment, the stop member 43 is configured to block the drive stroke when there are no nails 6 in the nail cartridge 41.

The operation of the nail gun according to the present disclosure is summarized below.

When the switch member 53 is at the sequential striking position and when the pivot movement of the trigger 51 is performed before the rearward movement of the linking member 501, the free end portion 522 of the inner arm 52 is withdrawn from the route of the rearward movement of said linking member 501 and the actuation of the drive stroke is avoided.

When the switch member 53 is at the sequential striking position and when the rearward movement of the linking member 501 is performed before the pivot movement of the trigger 51, the inner arm 52 is disposed on the route of the rearward movement of the linking member 501 so as to allow the actuation of the drive stroke.

When the switch member 53 is at the repetitive striking position, the inner arm 52 is disposed on the route of the rearward movement of said linking member 501 and when the trigger 51 is maintained at a pivoted state, each rearward movement of the linking member 501 will actuate the drive stroke.

To sum up, by moving the switch member 53 and thereby changing the relative position between the inner arm 52 and the linking member 501, the nail gun can be switched between the sequential striking mode and the repetitive striking mode, such that nail gun has a simplified structure and a smooth operation.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A nail gun comprising:

a housing;

a power device disposed in said housing for providing power during a drive stroke;

a muzzle device coupled to said housing, and including a plate member, and a safety member that cooperates with said plate member to define a nail ejection opening, that has an abutment end extending beyond said nail ejection opening, and that is retractable when said abutment end is pushed by an object to be fastened;

a cartridge device coupled to said muzzle device, adapted for supplying nails into said muzzle device for performance of the drive stroke, and including a stop member that is operable for blocking the drive stroke when a number of the remainder of the nails is less than a predetermined number; and a driving device including a linking unit that includes a linking member connected co-movably to said safety member, and a trigger unit that includes a trigger connected pivotally to said housing, an inner arm connected co-movably to said trigger, such that a pivot movement of said trigger and a rearward movement of said linking member which is driven by the retraction of said abutment end of said safety member cooperatively move said inner arm to actuate the drive stroke, and a switch member movable between a sequential striking position and a repetitive striking position;

wherein, when said switch member is at the sequential striking position, and when the pivot movement of said trigger is performed before the rearward movement of said linking member, said inner arm is withdrawn from a route of the rearward movement of said linking member, thereby avoiding actuation of the drive stroke.

2. The nail gun as claimed in claim 1, wherein, when said switch member is at the sequential striking position, and when the rearward movement of said linking member is performed before the pivot movement of said trigger, said inner arm is disposed on the route of the rearward movement of said linking member so as to allow the actuation of the drive stroke.

3. The nail gun as claimed in claim 1, wherein, when said switch member is at the repetitive striking position, said inner arm is disposed on the route of the rearward movement of said linking member, thereby allowing the actuation of the drive stroke under each rearward movement of said linking member when said trigger is maintained at a pivoted state.

4. The nail gun as claimed in claim 1, wherein:

said housing is formed with a positioning hole that has a first positioning portion and a second positioning portion;

said switch member engages movably said positioning hole;

said switch member is positioned at said second positioning portion of said positioning hole when said switch member is at the sequential striking position;

said switch member is positioned at said first positioning portion of said positioning hole when said switch member is at the repetitive striking position; and the movement of said switch member between the sequential striking position and the repetitive striking position drives movement of said trigger unit relative to said linking member.

5. The nail gun as claimed in claim 1, wherein:

said muzzle device further includes a barrel member that cooperates with said plate member to define a nail passage adapted for passage of the nails advanced from said cartridge device; and said nail ejection opening overlaps said nail passage.

6. The nail gun as claimed in claim 5, wherein said plate member includes a plate body, and a lock piece that is connected pivotally to said plate body and that engages removably said barrel member for maintaining relative position between said plate member and said barrel member.

7. The nail gun as claimed in claim 6, wherein said barrel member has two hook portions that cooperatively and removably hook said lock piece of said plate member.

8. The nail gun as claimed in claim 1, wherein said inner arm has:

a connecting end portion that is connected pivotally to said trigger; and a free end portion that is opposite to said connecting end portion, and that is withdrawn from the route of the rearward movement of said linking member when said switch member is at the sequential striking position and when the pivot movement of said trigger is performed before the rearward movement of said linking member.

9. The nail gun as claimed in claim 1, wherein said linking unit further includes a resilient member disposed between said linking member and said housing for biasing said abutment end of said safety member away from said nail ejection opening.

10. The nail gun as claimed in claim 1, wherein:

said cartridge device further includes a nail cartridge that is adapted for receiving the nails, and a push plate that is disposed in said nail cartridge, and that is slidable for advancing the nails into said muzzle device;

said stop member has a contact surface that faces said push plate;

said push plate has a protrusion that is in slidable contact with said contact surface of said stop member when the number of the remainder of the nails is less than the predetermined number to push said stop member to the route of the rearward movement of said linking member, thereby blocking the drive stroke.

11. A driving device adapted for use in a nail gun, the nail gun including a muzzle device that includes a plate member, and a safety member that cooperates with the plate member to define a nail ejection opening, that has an abutment end extending beyond the nail ejection opening, and that is retractable when the abutment end is pushed by an object to be fastened, said driving device comprising:

a linking member adapted to be connected co-movably to the safety member;

a trigger being pivotable;

an inner arm connected co-movably to said trigger, such that a pivot movement of said trigger and a rearward movement of said linking member which is driven by the retraction of the abutment end of the safety member cooperatively move said inner arm to actuate a drive stroke; and a switch member movable between a sequential striking position and a repetitive striking position;

wherein, when said switch member is at the sequential striking position, and when the pivot movement of said trigger is performed before the rearward movement of said linking member, said inner arm is withdrawn from a route of the rearward movement of said linking member, thereby avoiding actuation of the drive stroke.

12. The driving device as claimed in claim 11, wherein, when said switch member is at the sequential striking position, and when the rearward movement of said linking member is performed before the pivot movement of said trigger, said inner arm is disposed on the route of the rearward movement of said linking member so as to allow the actuation of the drive stroke.

13. The driving device as claimed in claim 11, wherein, when said switch member is at the repetitive striking position, said inner arm is disposed on the route of the rearward movement of said linking member during the pivot movement of said trigger, thereby allowing the actuation of the drive stroke under each rearward movement of said linking member when said trigger is maintained at a pivoted state.

14. The driving device as claimed in claim 11, wherein:

said switch member is adapted for engaging movably a positioning hole that is formed in the nail gun;

said switch member is adapted to be positioned at a first positioning portion of the positioning hole when said switch member is at the repetitive striking position;

said switch member is adapted to be positioned at a second positioning portion of the positioning hole when said switch member is at the sequential striking position; and the movement of said switch member between the sequential striking position and the repetitive striking position drives movement of said trigger unit relative to said linking member.

15. The driving device as claimed in claim 11, wherein said inner arm has:

a connecting end portion that is connected pivotally to said trigger; and a free end portion that is opposite to said connecting end portion, and that is withdrawn from the route of the rearward movement of said linking member when said switch member is at the sequential striking position and when the pivot movement of said trigger is performed before the rearward movement of said linking member.

16. The driving device as claimed in claim 11, further comprising a resilient member that is connected to said linking member for biasing said abutment end of said safety member away from said nail ejection opening.

* * * * *